United States Patent [19]

Carver

[11] Patent Number: 4,838,704

[45] Date of Patent: Jun. 13, 1989

[54] MIXER APPARATUS

[76] Inventor: David L. Carver, Carver Machine Works, Rte. 5, Box 76, Riverside Dr., Washington, N.C. 27889

[21] Appl. No.: 133,073

[22] Filed: Dec. 15, 1987

[51] Int. Cl.[4] ..... B01F 7/04

[52] U.S. Cl. ..... 366/307; 366/325; 366/329

[58] Field of Search ..... 366/302, 303, 306, 307, 366/315, 316, 317, 325, 328, 329, 279; 68/135

[56] References Cited

U.S. PATENT DOCUMENTS

| | | | |
|---|---|---|---|
| 271,242 | 1/1883 | Hobbs | 366/307 |
| 452,147 | 5/1891 | Nuebling | 366/303 |
| 661,796 | 11/1900 | Ernest | 366/329 |
| 1,379,707 | 5/1921 | La Croix | 366/303 |
| 1,520,375 | 12/1924 | Trust et al. | 366/302 |
| 1,740,657 | 12/1929 | Komarek | 366/325 |
| 2,563,937 | 8/1951 | Keight et al. | 366/303 |
| 2,746,729 | 5/1956 | Eakins | 366/303 |
| 2,990,710 | 7/1961 | Burling | 68/135 |
| 3,133,728 | 5/1964 | Janke | 366/329 |
| 3,709,664 | 1/1973 | Krekeler et al. | 366/303 |

FOREIGN PATENT DOCUMENTS

| | | | |
|---|---|---|---|
| 378115 | 9/1907 | France | 366/303 |

*Primary Examiner*—Harvey C. Hornsby
*Assistant Examiner*—Joseph S. Machuga
*Attorney, Agent, or Firm*—Richard C. Litman

[57] ABSTRACT

A pulp mixing apparatus includes a rotor shaft within a housing having a curvilinear inner wall circumferentially disposed about the rotor. A plurality of radially extending, wedge-shaped vanes are rigidly mounted on the rotor and intermesh with a plurality of housing vanes, likewise wedged-shaped, such that in combination, as the rotor vanes are moved into proximity with the stationary housing vanes, a mixing substance is subjected to a compressive and subsequently to a decompressive force whereupon the mixing substance is homogeneously and thoroughly mixed.

4 Claims, 4 Drawing Sheets

MIXER APPARATUS

FIELD OF THE INVENTION

The present invention relates generally to a mixing apparatus and more particularly, to an improved device for the mixing of various products and is intended to be used in conjunction with mixers that utilize chemicals, gasses, liquids or steam, such as devices for mixing bleaching chemicals with pulp.

BACKGROUND OF THE INVENTION

The present mixing apparatus is especially adaptable for the mixing of pulp as in the manufacture of paper products and other related products based on the use of wood fibres. Further, the invention is intended for use in combination with those devices and methods of manufacture utilized in the mixing operation of the pulp with chemicals, for example, liquid compositions such as chlorine dioxide for bleaching wood pulp.

Further, this device relates to an improved means for mixing pulp, and other similar mixing operations, such that a vastly improved homogeneous mixing the pulp and treatment chemical takes place, with a substantially more effective utilization of energy and chemicals to achieve a given level of brightness of bleached pulps. Thus, a higher quality of pulp product is realized and at a lower cost, through the application of this invention to the manufacturing process.

This device further relates to an improvement in the mixing apparatus of pulps such that a lower impurity rate and a lower consumption rate per ton of substance to be mixed with the pulp produces a higher and more consistent brightness of bleached pulp, and further relates to those devices for producing lower off quality product levels and which may involve lower temperatures or steam consumption.

DESCRIPTION OF THE PRIOR ART

The following cited references are found to be exemplary of the prior art. They are:

U.S. Pat. No. 284,232, issued to Quirin, discloses a pulp washing machine that mixes the pulp thoroughly with water and employs a rotatable shaft, consisting of prongs or beaters that intermesh with stationary, vertical-projecting prongs. The prongs are permanently fixed to the bottom of the box. It is the action of the prongs or beaters by which the pulp is washed.

U.S. Pat. No. 621,203, to Draughtsman, teaches a construction for a meat-cutting machine that employs a rotating shaft with radial arms of diamond shape extending therefrom. The action of the arms mixes and carries the meat and articles of food transversely along the axis of the shaft, gradually expelling the mixture past the fixed arms and out of the apparatus.

U.S. Pat. No. 1,725,868, issued to Kenyon, discloses an apparatus for conditioning gravel, sand and the like. It consists of a transversely rotating shaft, carrying radiating arms that are held in a radial position by centrifugal force and strike against the oncoming mass of material, breaking up the bodies of clay or other foreign matter and causing the same to dissolve.

U.S. Pat. No. 2,169,338, to Ditto, discloses a device to provide an emulsifying mill adapted to emulsify various mixtures of liquids to such an extent that the resulting emulsion will resist separation by reaction, such as centrifugal force, static setting and freezing. It employs V-shaped members extending radially from each stationary amalgamating disc to form passageways through which liquid is forced through the circumference of the disc.

U.S. Pat. No. 2,990,710, issued to Burling, illustrates a pulp bleaching apparatus employing a mixer having radial pegs on both a housing/stator and cooperating rotor and which would be utilized in an environment similar to the present invention but which lacks the unique interacting vanes as advanced herein.

U.S. Pat. No. 3,293,117, to Pennington, Jr. et al discloses an apparatus for mixing of liquids with wood pulp, cellulose, or the like, or more particularly, for mixing of high concentrations of densities of pulp and liquid bleaching chemicals in a continuous flow fashion as distinguished from bath mixing processes. This device employs concavely curved spreading vanes, mounted on a rotating shaft that pick up the pulp in front of the liquid inlet and cause the mass of pulp to rotate at the same angular velocity as the vanes themselves. This process causes the pulp to move longitudinally in the chamber and causes the chemical to be sprayed or spread onto surfaces of a succession of discs of pulp.

U.S. Pat. No. 4,207,760, issued to Bochan, teaches a construction of a vane arrangement for a vertial-axis, clothes-washing machine.

SUMMARY OF THE INVENTION

A primary object of the present apparatus is to provide an improved pulp mixing device with a higher efficiency in both required energy input per ton of substance mixed with the input material, as well as an improved output quality containing a lower amount of impurities, such as shives, undissolved fibers or other substances.

A further object of the present invention is to provide a means for a more thorough mixing of pulp such that there are less downstream residuals of the substance mixed with the pulp along with a higher and more consistent brightness level of bleached pulps in the manufacturing process.

Another object of the invention is to provide means for subjecting the pulp to an alternate shearing, compression and decompressive force such that the de-compressive action enhances the mixing process and wherein the pulp is subjected to an implosive condition that more homogeneously mixes the pulp and the treating substance or chemical. This force and reaction will hereafter be referred to as a hydraulic shock action.

These, together with other objects and advantages of the invention reside in the details of the process and the operation thereof, as is more fully hereinafter described and claimed.

DESCRIPTION OF THE PREFERRED EMBODIMENT

Figure 1:
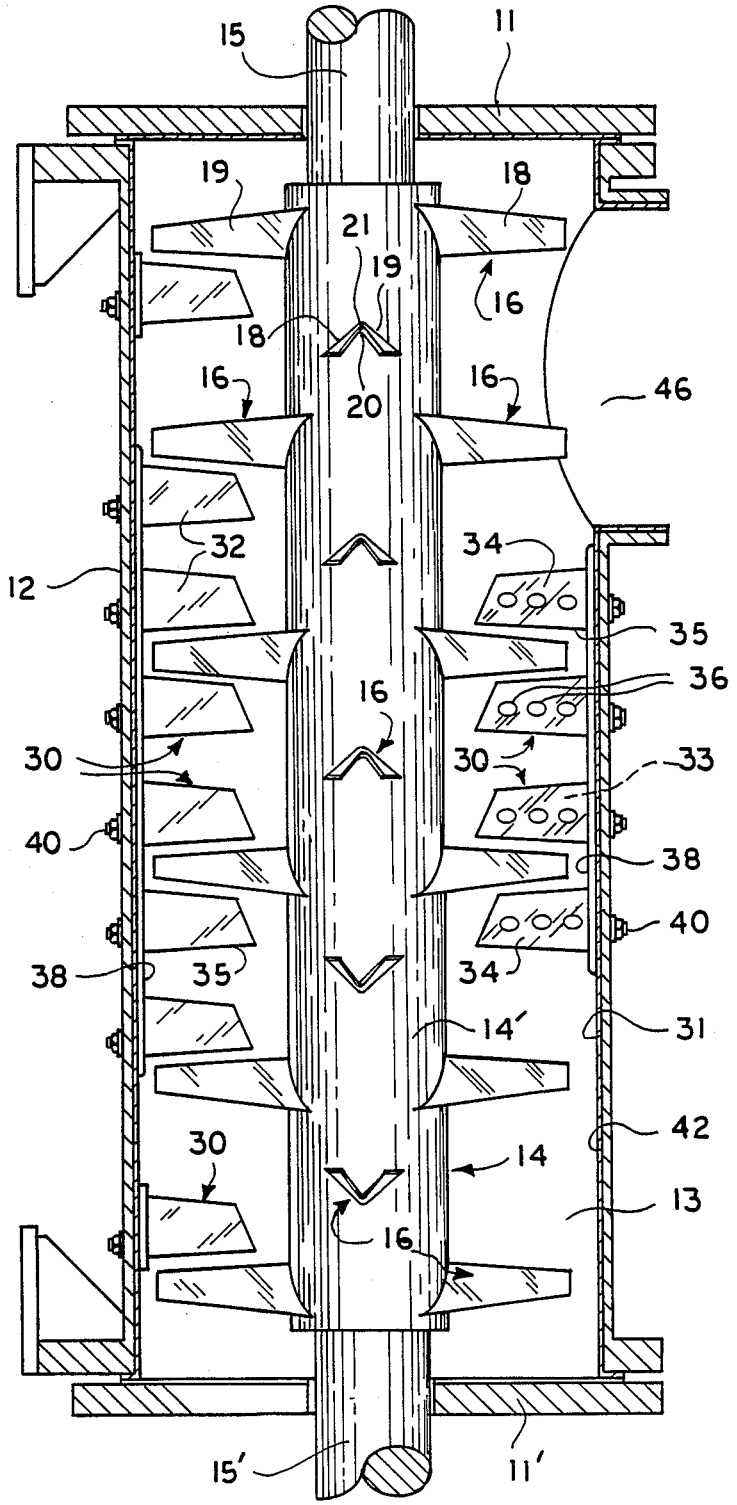
FIG. 1 is a longitudinal sectional view of a typical mixer incorporating the present invention.
Figure 2:
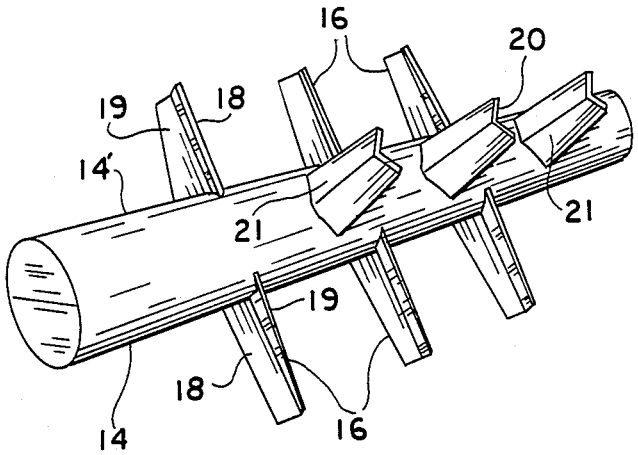
FIG. 2 is a perspective view of the rotor of the mixer shown in FIG. 1 and illustrates the plurality of vanes thereon.

Referring now to the drawings, the mixer according to the present invention is generally designated 10 and will be seen to include an outermost cylindrical housing 12 containing a lining 42 defining an interior chamber 13 bounded by opposite end walls 11,11'. An elongated rotor 14 with an axis and circumferentially opposite sides is disposed within the chamber 13 by means of end shafts 15,15' extending through the respective end walls 11,11'. Suitable well known bearing and packing means (not shown) are utilized to provide appropriate fluid tight journals for the rotor shaft ends 15,15' and additionally, it will be understood that suitable drive means would be provided to supply motive force, rotating the rotor 14 during operation of the mixer, which mixer may be either of the axial or radial flow type.

The hub 14' of the rotor will be seen to be provided with a plurality of fixed, radially projecting vanes 16 arrayed with pairs of said rotor vanes extending in opposite directions from opposite sides of the rotor shaft 14 and arranged to form a plurality of groups of such vanes, each group disposed in axial alignment, as shown most clearly in FIG. 1. The plurality of rotor vane groups are in turn angularly offset relative each other as evident from the end elevational view of FIG. 3.

Each rotor vane 16 comprises a unitary member including first and second substantially planar, imperforate elements 18,19 being mirrored imaged congruent surfaces joined at an edge or apex 21 and defining a V-shape or chevron symmetrical about apex 21, in cross-section, such that a wedge-shaped trough or cavity 20 is formed between or within the confines of each pair of such elements 18,19. As shown, the open side or trough 20 of the vanes 16 nearest each end wall 11,11' are disposed in a direction facing that end wall but any vane may be facing either direction. Although the individual vanes 16 of each group are axially equispaced, it will be observed that the vanes of arcuately adjacent groups are axially staggered relative one another.

Figure 3:
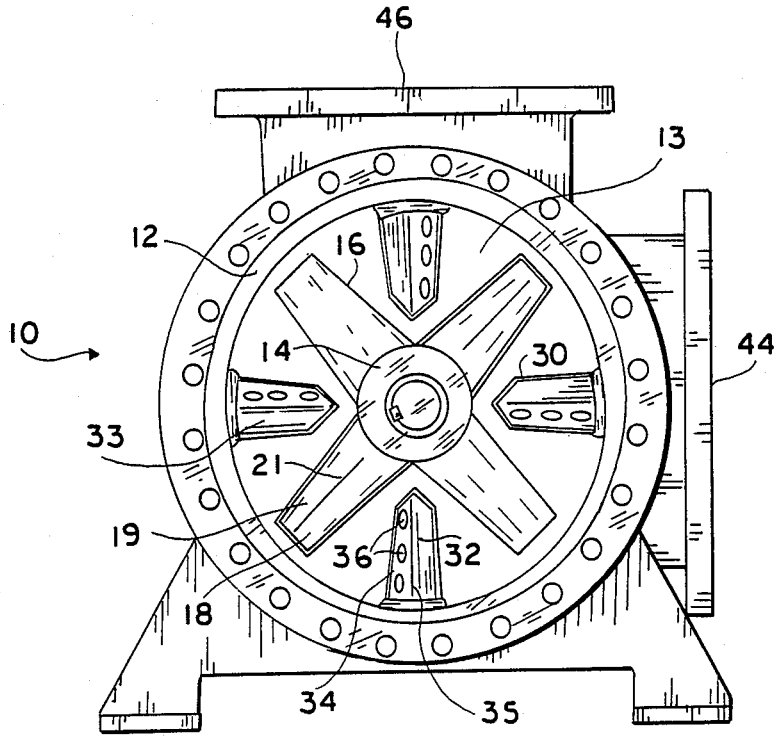
FIG. 3 is an end elevational view of a mixer such as shown in FIG. 1, with an end wall removed.
Figure 4:
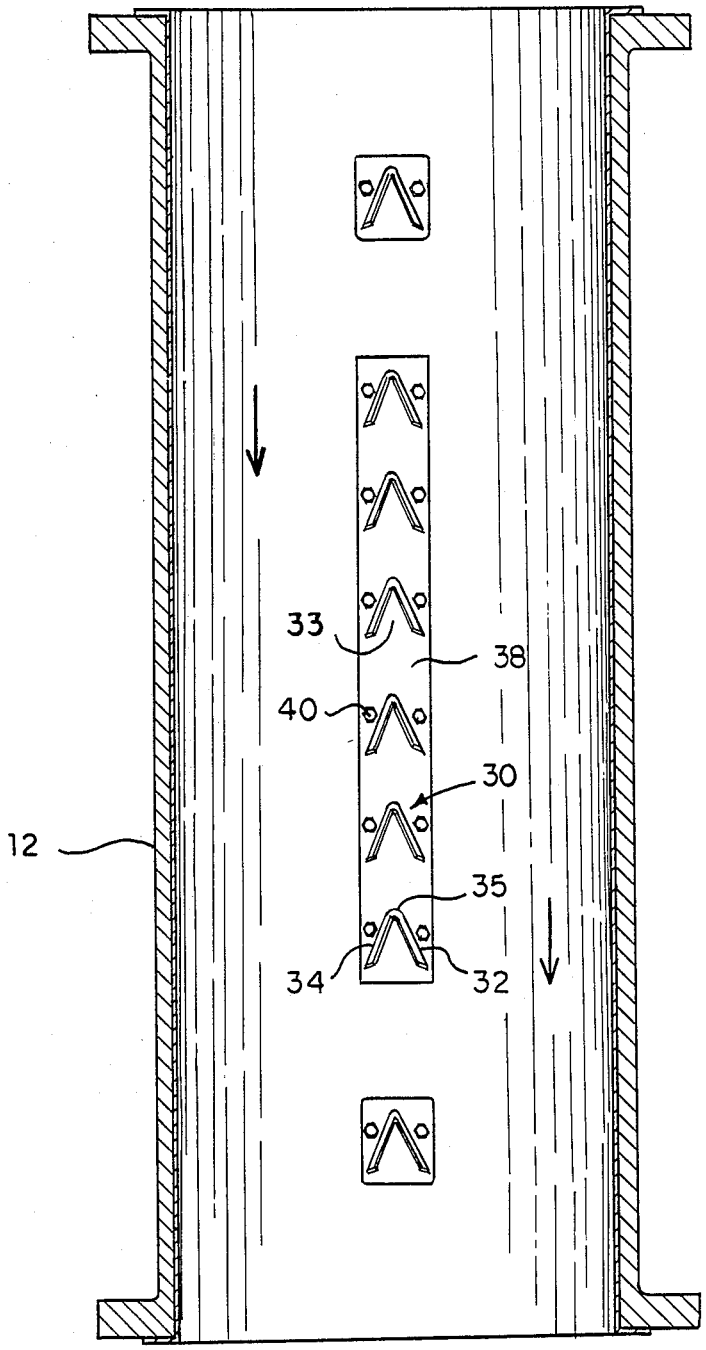
FIG. 4 is a horizontal sectional view illustrating the plurality of vanes on the bottom of the housing or stator of FIG. 1.

Cooperating with the rotor vanes 16 are a plurality of stator or fixed vanes 30 radially extending inwardly from the inner wall 31 of the housing 12 or the liner 42. These vanes 30 likewise each comprise a unitary member including a first 32 and second 34 elements in mirroredly image congruent form joined at an apex 35 and defining a V-shape or chevron symmetrical configuration about apex 35 in cross-section, with a trough or cavity 33 within the confines of the two divergent elements. The included angle between the two elements 32,34 may range between 45–90 degrees. The first elements 32 are preferably imperforate as shown in FIG. 3 while the second elements 34 may be provided with a plurality of radially adjacent apertures 36. The four groups of stator vanes 30 are likewise arcuately arranged at a 90 degree displacement from each other, or alternatively, any other suitable number of groups with equal spacing may be employed, such as three groups spaced 120 degrees apart.

Since the unique structure of the present vanes is particularly adaptable for use in a mixer 10 as utilized in the pulp bleaching industry, it will be appreciated that many existing mixer housings may be modified or retrofitted with the present improvement. In this respect, it will follow that stator members 30 in accordance with this invention may easily be placed within existing housings with the stator vanes 30 suitably affixed relative the housing wall 31 or liner 42. In the latter respect, each group of stator vanes 30 are shown in FIG. 1 as being mounted upon a base plate 38 which in turn is suitably mounted in place, such as by the fasteners 40. The intermediate liner 42 may or may not be included and will be understood to be constructed of suitable material intended to resist the chemical action of pulp being treated within the mixer 10.

In one manner of operation, the pulp/treatment chemical mixture is admitted to the mixer chamber through an inlet 44 laterally disposed adjacent one end wall 11'. The mixture is supplied to the apparatus by any well known gravity or pressure feeding arrangement and after treatment, is forced from the housing 12, through an uppermost outlet 46 adjacent the opposite end wall 11 so determining an upstream and downstream direction. It will be understood that the specific placement of both the inlet and outlet are not critical for the improved performance of the invention as alternate locations or angular positions are possible.

A superior mixing action is accomplished as the rotating vanes 16 intermesh with the stator vanes 30 to produce a hydraulic shock action whereby the mixture is alternately compressed and uncompressed. The stator design and placement is intended to increase the differential occurring between the rotor speed and the pulp/substance mixture rotating speed in order to create higher shear forces. The alternately along the axis of the rotor forward and rearward facing upstream and downstream apexes 21 and troughs or cavities 20 of the rotor vanes 16 promote an improved compression of the mixture as the rotor vanes direct the mixture against the imperforate first elements 32 of the stator vanes 30. All of the stator vanes will be seen to have their apices 35 disposed in the same direction, that is, facing toward the inlet 44 of the mixer 10 so that the mixer migrating toward the outlet 46, will be successively sheared by the stator vanes 30 as portions thereof are compressed due to the acton of the rotating rotor vanes 16 being driven between axially adjacent stator vanes 30. This same action may be accomplished by positioning all or part of the stator vanes 30–180 degrees from the position reflected in the drawings. As the rotor vanes 16 pass the first elements 32 of the stator vanes 30, continued movement of the rotor vanes creates a partial vacuum or pressure reduction between the stator and rotor vanes as well as immediately inside the trough 20 of the rotor vanes. This vacuum is somewhat regulated by means of the apertures 36 in the second stator vane elements 34 so as to reduce the amount of horsepower required to operate the mixer. Thus, a constant series of hydraulic shock actions are produced upon the pulp mixture as the rotor 14 operates at a substantially regular speed whereupon, a vastly improved mixing is achieved. Operation of the device produces a discontinuity in the movement of the material, with an instability that is implosively self-correcting as atmospheric or feed pressure acts to restore a pressure density to the mixture.

The material directed through the mixture 10 undergoes a thorough, homogeneous mixing due to a combination of factors including, the shearing action as the pulp is forced around the rotor vanes 16 and then flows about the stator vanes 30, as well as the resultant hydraulic shock action as produced by the specifically configured vane elements. The present invention produces an improved mixing action over earlier mixers while operating with a maximum utilization of horsepower and requiring less chemical treating substance.

The apparatus is adaptable to a variety of differing mixing applications by altering the relative spacing of the stator vanes 30 circumferentially about the housing inner wall 31, and the spacing of the plurality of rotor vanes 16, circumferentially on the rotor hub 14'. Additionally, the relative clearance between the intermeshing rotor and stator vane may be varied. Further, the rotor vanes may be varied in configuration, such that only a portion thereof consists of the wedge-shaped trough members as described herein. The relative advantage of this is that when working with many mixtures it may be necessary to vary the mixing action and the rpm of the rotor so that the rate of mixing can be controlled to achieve the desired level of results with certain mixtures.

Figure 5:
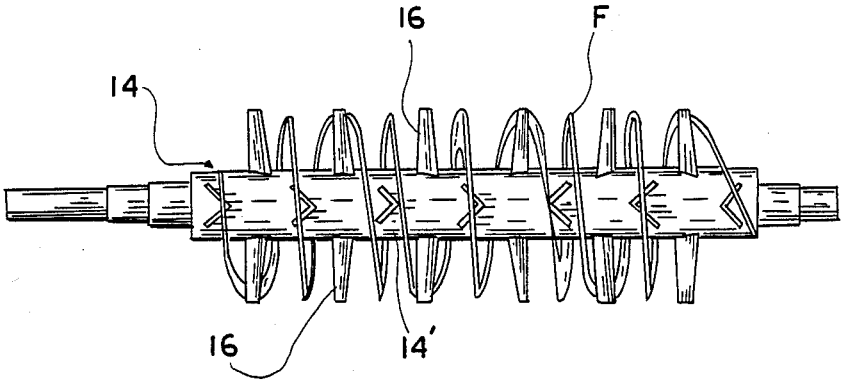
FIG. 5 is a schematic diagram indicating by means of a helical representation, a typical flowline of pulp and substance through a mixer not employing the advancement of the present invention.

The flow path F depicted in FIG. 5 will be understood to represent a regular, helical path. With the pulp rotating speed similar to that of the rotor speed, having little differential, such as would occur when using a rotor as shown and without the cooperating stator vanes 30 of the present invention, which produce the unique mixing through the hydraulic shock action or alternate compression and decompression of the mixture. As mentioned before, the stator construction and disposition enhances the differential occurring between the rotor speed and the pulp/substance mixture rotating speed so as to create higher shear forces.

Although the inventive arrangement is illustrated as applied to a mixer having a material flow which progresses generally axially along a rotor shaft, it will be appreciated that the disclosed concept of the cooperating rotor vanes and stator members may be practiced with alternate mixer designs such as, a radial flow mixer having parallel discs provided with opposing vanes and stators.

It will be apparent from the foregoing that the objects and advantages of the invention have been realized and further, as many small changes will occur to those skilled in the art, it is desired that all equivalents thereof fall under the scope of invention as defined in the appended claims.

What is claimed is:

1. A pulp mixing apparatus, comprising, a cylindrical housing having a rotor shaft with an axis and circumferentially opposite sides rotationally mounted within said cylindrical housing, a curvilinear interior wall circumferentially disposed about said rotor shaft to form thereby a mixing cavity;

said housing having an inlet and an outlet thereon providing means for entry of material into said mixing cavity and means for egress therefrom, determining an upstream direction and a downstream direction, a plurality of rotor vanes radially mounted along the axis on said rotor shaft, arrayed with pairs of said rotor vanes extending in opposite directions from said opposite sides of the rotor shaft, said rotor vanes each having a rotor primary surface and a rotor secondary surface that forms a mirroredly imaged congruent surface of said rotor primary surface, said primary surface and said secondary surface joined in a cross sectional chevron symmetrically about and along a common edge, said housing interior wall having radially affixed thereto a plurality of stators; said stators each having a stator primary surface and a stator secondary surface that forms in outline a mirroredly imaged congruent form of said stator primary surface, said stator primary surface and said stator secondary surface joined in chevron symmetrically about and along a common edge to define a wedge shaped cavity therebetween; said stators having a plurality of orifices therein;

certain of said rotor vane common edges facing in said upstream direction with the balance of said rotor vane common edges facing in said downstream direction, and said rotor vanes and said stators arrayed with respect to one another such that said rotor rotates and said vanes pass in proximity to said stators, a mixing action is established such that a material mixing therewithin is displaced rotationally, and is compressed as it nears a stator; and is further subjected to a suction or negative atmospheric force as said rotor vanes continue past said stators; whereafter the material displaced from said rotors moves around said stators as a vacuum is relieved by said stator orifices and said material being further subjected to an implosion as a direct result of the atmospheric action thereon, whereby the material undergoes a homogeneous mixing action.

2. A mixing apparatus as recited in claim 1 including, at least one base plate, a plurality of said stators affixed to said base plate to define a group of stators and, fastener means connecting said base plate within and to said housing.

3. A mixing apparatus as recited in claim 1 wherein, said rotor vanes and stators define a symmetrical configuration when viewed in end elevation.

4. A mixing apparatus as recited in claim 1 wherein, said stator orifices are disposed through said second surface of said stators.

* * * * *